United States Patent [19]

Ottenheimer

[11] 4,417,727

[45] Nov. 29, 1983

[54] ISOMETRIC EXERCISER

[76] Inventor: Charles J. Ottenheimer, 205 Lewers St., Suite 808, Honolulu, Hi. 96815

[21] Appl. No.: 348,030

[22] Filed: Feb. 11, 1982

[51] Int. Cl.[3] ..... A63B 21/00

[52] U.S. Cl. ..... 272/125; 272/67

[58] Field of Search ..... 272/125, 137, 143, DIG. 8, 272/DIG. 5, 67, 68, 126

[56] References Cited

U.S. PATENT DOCUMENTS 3,219,342 11/1965 Melchiona ..... 272/68
3,746,336 7/1973 Tanimoto ..... 272/67

FOREIGN PATENT DOCUMENTS 29331 7/1907 Austria ..... 272/DIG. 8
646555 8/1962 Canada ..... 272/125

*Primary Examiner*—Richard J. Apley
*Assistant Examiner*—William R. Browne

[57] ABSTRACT

An isometric exercise apparatus having a pair of spaced apart parallel hand grips having bars holding the hand grip in place. At least one of the bars has an orientation device thereon that is used to orient the exercise apparatus with the body of the user.

5 Claims, 2 Drawing Figures

ISOMETRIC EXERCISER

BACKGROUND OF THE INVENTION

This invention relates to apparatus useful as an isometric exerciser. More particularly, it relates to a device having a pair of offset spaced handles and indicating means imprinted on the handles for orienting the apparatus at various angles with respect to the user's body.

In recent years, the importance of exercise to maintain proper health of the human body has become widely recognized. While many people recommend exercises which substantially increase the heart rate for extended periods of time, many people are unable to perform these exercises for medical reasons, and others may be unable to take time out of a busy schedule to perform such exercises. Therefore, to maintain muscle tone and relieve stress and tension, large numbers of people engage in performing isometric exercises. These exercises may be performed with little or no equipment, and can be easily performed in an office or at home without the necessity of changing cloths or visiting a gymnasium. Isometric exercises involve the stressing of muscles against a resistance, without the significant shortening of muscle fibers. Typical examples of isometric exercises involve locking of the hands in front of the body and either attempting to pull the hands apart, or pressing the palms together, thereby creating muscle tension. These actions result in the tensioning of various muscles in the wrists, arms, shoulders, chest, and back, thereby resulting in toning of these muscles.

The device of the invention provides a simple yet highly useful aid for isometric exercising. The device consists of a pair of parallel handles spaced by a "Z"-shaped spacing member such that when the device is held away from the body in normal operating position, one handle extends farther from the body than the other handle. The spacing member has a guide imprinted thereon which permits the user to orient the device relative to the body at several fixed orientations, each of which emphasizes the exercise of slightly different groups of muscles. The guide enables the user to easily follow an instruction booklet explaining the utility of the device for exercising different muscle groups.

Accordingly, it is an object of the present invention to provide an easily portable, lightweight, inexpensive device having no moving parts and which serves as an isometric exercising device. It is a further object of the invention to provide an isometric exerciser having a pair of handles and a spacing bar having directional orientation indicators imprinted on both sides of the spacing bar. It is a further object of the invention to provide an isometric exercising device which can be used in exercising a wide variety of muscle groups, and which correlates easily with an instruction manual which explains the use of the device for the exercise of various muscle groups. These and other objects of the invention will be apparent from the following detailed description of a preferred embodiment of the invention.

SUMMARY OF THE INVENTION

An isometric exercising apparatus comprises a pair of spaced parallel grip means and at least one spacing bar for maintaining the grip means in rigid parallel relationship. The spacing bar is preferably "Z" shaped to render the handles in offset orientation with respect to the body during normal usage. A direction-indicating guide is imprinted on both sides of the spacing bar to permit easy orientation of the device in various positions with respect to the user's body.

BRIEF DESCRIPTION OF THE DRAWINGS

The invention is best understood with reference to the drawings, in which.

DETAILED DESCRIPTION OF A PREFERRED EMBODIMENT

Figure 1:
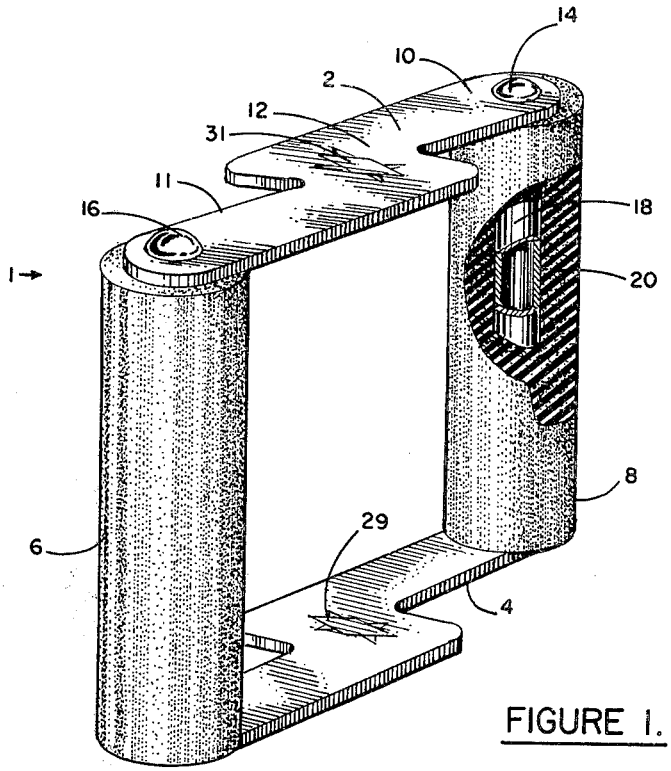
FIG. 1 is a perspective view of the exercising device with a portion of one of the handles cut away.

Referring to FIG. 1, isometric exerciser 1 has a pair of handles or grip means 6 and 8 which are maintained in fixed parallel relationship by upper and lower spacing members or bars 2 and 4. The spacing members are rigid, "Z"-shaped aluminum sheet having a thickness of about 3/32". Upper spacing member 2 has coplanar offset end portions 10 and 11, and a substantially perpendicular central portion 12. The bottom spacing bar 4 is of identical shape.

The grips 6 and 8 are rigidly mounted between the spacing bars and are fastened in place by carriage bolts 14 and 16 which extend through bores (not shown) in the spacing bars and through the central portion of the grips. The carriage bolts are fastened by cap nuts 22 and 24 which threadedly engage the end portions of the bolts (see FIG. 2). Washers 24 and 26 mount between the cap nuts and the bottom spacing bar 4. Grips 6 and 8 are identical; grip 8 as shown in section view in FIG. 1 consists of an internal rigid tubular member 18 covered by a concentric layer of dense foam rubber of a type commonly commercially used for racing bicycle handle grips. If desired, to ensure that the handles will not move relative to each other during use of the device, circular grooves may be formed around the carriage bolt receiving holes in the spacing bars to receive each end portion of the structural tubing shields. For example, upon assembly of grip 8, each end of tube member 18 would slide into a circular groove on the inner side of spacing members 2 and 4, thus preventing the tubing member from sliding once the carriage bolt is locked in place.

The grips are preferably fabricated from a resilient material such as dense foam rubber, and are preferably not formed with finger indentations. Since the grips are held from both the inside and outside, and in a number of different orientations, preformed finger indentations are not desirable.

While the spacing bars between the grips may be straight, they are preferably "Z"-shaped. The "Z" shape of the spacing bars provides a slight offset of the handles with respect to the body if the device is held in a normal orientation away from the body. Accordingly, when a user grips the handles and pushes them together or pulls them apart, as would be the case with a normal isometric exercise, the offset handles impart a natural rotational force or torque which stresses different muscles than if the handles were held equidistant from the body. While the inner section of each spacing bar preferably is oriented perpendicularly to the end portions, the angle may range from about 45° to about 135°. Best results have been obtained when the central portion is substantially 90° to the end portions. The important factor is that the end portions of each spacer bar be parallel to and offset from each other, preferably at a distance (as measured along the center lines) of at least 1" and not more than 3", and preferably from 1½ to 2½". The particular angle made by the central portion to achieve this offset is less important.

Of particular importance to the exercising device of the invention are directional guides which are imprinted on the inside and outside surfaces of spacing bars 2 and 4, respectively. Guide 29 is imprinted on the inside of spacer bar 4, while guides 30 and 31 are imprinted on the outer sides of the bars. The guides are visible to the user from virtually any orientation of the device in front of the user. Any type of guide means, such as arrows, punched holes, lines, or the like may be used. The guides may be etched or molded into the bars, or may be attached. e.g. by decals.

Figure 2:
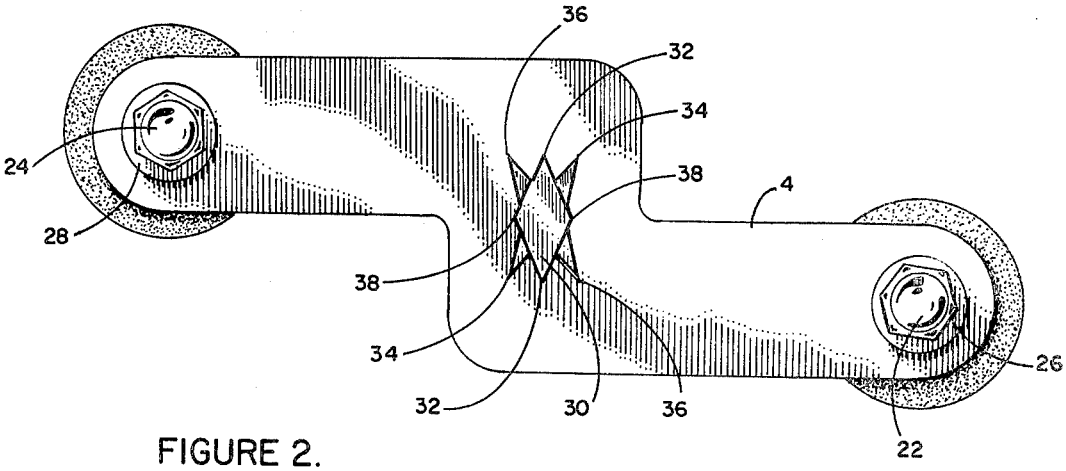
FIG. 2 is a bottom view of the device.

As shown in FIG. 2, directional guide 32 is a symmetrical figure having opposing pairs of points 32—32, 34—34, 36—36, and 38—38. As defined by straight lines drawn through each pair of points, points 34—34 and 36—36 each form an angle of 30° with points 32—32, and points 38—38 form a 90° angle to points 32—32. In using the isometric exercise device, to exercise various groups of muscles the user grips the device in a manner and orientation as set forth in an instructional booklet. By orienting various sets of points e.g., toward his chest as set forth pictorialy in the instruction booklet, the user can precisely duplicate the exercise set forth in the booklet.

The exerciser may be gripped in four different ways: with both hands gripping the unit from the outside, with both hands gripping the unit from the inside, with the left hand inside and the right hand outside the unit, and with the right hand inside and the left hand outside the unit. By utilizing these four different grips and four different angles of isometric stress, and by further rotating the device in a vertical plane to various orientations, a very large number of different exercise positions and different muscle groups may be exercised.

It will be apparent to those skilled in the art that a number of variations in the specific embodiment described herein may be made within the spirit and scope of the invention. For example, different materials of construction may be used for fabrication of the grips and spacing bars, and in theory a single spacing bar rather than a pair as shown in the drawings may also be used. The single bar may be located either at the end of the grips or centrally thereto. Furthermore, any means of orienting the handles with respect to the chest of the user is contemplated, the star-shaped emblem located on the spacer bar as shown herein being merely a single embodiment thereof. Accordingly, the invention should not be considered limited with respect to the specific disclosure herein, but should rather be limited only by the following claims.

I claim:

1. Isometric exercise apparatus comprising a pair of hand grips, a pair of parallel Z-shaped rigid spacng bars having end portions thereof attached to each hand grip, and oriention means on at least one of said spacing bars for assisting the user in orienting the apparatus in various positions with respect to the user's body when performing various isometric exercises.

2. The apparatus of claim 1 wherein each spacing bar comprises two coplanar parallel end portions having center lines offset from each other by a distance of from about 1" to about 3".

3. The apparatus of claim 2 wherein the center lines are offset by a distance of about 1½" to about 2½".

4. The apparatus of claim 1 wherein said orientation means comprises direction indicators on the inside and outside of the spacing bars.

5. Isometric exercise apparatus comprising a pair of hand grips, rigid spacing means for maintaining the hand grips in fixed spaced apart parallel relationship to each other, orientation means for assisting the user in orienting the apparatus in various positions with respect to the user's body when performing various isometric exercises, said orientation means being positioned on at least one of the spacing means and comprising a design having a plurality of direction-indicating symbols therein.

* * * * *